US005435280A

United States Patent [19]

Hackett et al.

[11] Patent Number: 5,435,280

[45] Date of Patent: Jul. 25, 1995

[54] METHOD OF MOUNTING A CERAMIC VALVE GUIDE ASSEMBLY

[75] Inventors: David E. Hackett, Washington; Michael H. Haselkorn, Peoria, both of Ill.

[73] Assignee: Caterpillar Inc., Peoria, Ill.

[21] Appl. No.: 247,167

[22] Filed: May 20, 1994

[51] Int. Cl.[6] ..... F01L 3/08

[52] U.S. Cl. ..... 123/188.9; 29/888.061

[58] Field of Search ..... 123/188.2, 188.3, 188.9, 123/188.11; 29/888.06, 888.061, 214

[56] References Cited

U.S. PATENT DOCUMENTS

| | | | |
|---|---|---|---|
| 3,809,046 | 5/1974 | Kameraad | 123/188.9 |
| 4,688,527 | 8/1987 | Mott et al. | 123/188 |
| 5,207,196 | 5/1993 | Koonen et al. | 29/214 |
| 5,237,103 | 12/1994 | Hackett et al. | 123/188.3 |
| 5,313,917 | 5/1994 | Santi | 123/188.9 |

FOREIGN PATENT DOCUMENTS 2310368 9/1974 Germany .

OTHER PUBLICATIONS

Exhibit A–Ringfeder Shaft–Hub Locking Devices–Locking Elements RfN 8006 and GSA–Series–Ringfeder Corporation, Arlington Hts., Ill.

*Primary Examiner*—Henry C. Yuen
*Assistant Examiner*—Erick Solis
*Attorney, Agent, or Firm*—Diana L. Charlton

[57] ABSTRACT

In order to achieve great engine efficiency, heat, normally dissipated through the cooling system, is directed through the exhaust passage to increase the turbocharger speed. Ceramic valve guides capable of withstanding high temperature ranges are being used for increased engine efficiency. Unfortunately, the resultant interference fit achieved through conventional shrink fitting the ceramic valve guide into the cylinder head will be lost once the engine is at operating temperatures due to the differential thermal expansion between the ceramic and the cylinder head material. The present invention provides a simple means for ensuring that the ceramic valve guide will be mounted within a cylinder head in a way that ensures that the ceramic valve guide is held in place within the cylinder head throughout the operating cycles of the engine. This is accomplished by utilizing a securing assembly which circumferentially surrounds the ceramic valve guide. The securing assembly includes a lower and an upper securing element and a spring disposed between the lower and the upper securing element. When installed in the engine, a valve spring places an axial load on the securing element which compresses the spring and forces the lower and the upper securing element into radial engagement with the ceramic sleeve and the cylinder head. Thereby, forcibly connecting the ceramic valve guide and the cylinder head.

11 Claims, 2 Drawing Sheets

METHOD OF MOUNTING A CERAMIC VALVE GUIDE ASSEMBLY

TECHNICAL FIELD

This invention relates generally to a ceramic valve guide assembly and more particularly to mounting the ceramic valve guide assembly in a cylinder head of an internal combustion engine.

BACKGROUND ART

Present internal combustion engines are being manufactured for increased efficiency and greater horsepower outputs. In order to achieve greater efficiency, exhaust temperatures are increased as less heat is transferred to the cooling system. The increased exhaust temperatures increase the output of any exhaust energy recovery hardware, such as the turbocharger, and subsequently, the performance of the engine. Typically, current engine valve guides are made from an iron base material which operate within a limited maximum temperature range. Consequently, the iron base valve guides are not conducive for operating within the high exhaust temperature ranges reached with high efficiency engines. In order to utilize a valve guide within high exhaust temperatures, alternative materials must be used. One proposed solution to the above problem is to use a ceramic material for the valve guide. Ceramics typically have much higher temperature capabilities than the current iron based material. However, the use of ceramic materials for the valve guide is complicated by their typically low coefficient of expansion. If the valve guide material is merely changed from the current iron based material to a ceramic and it is installed in the conventional manner, such as shrink-fitting into the cylinder head, the resulting interference fit will disappear when the engine is brought up to operating temperature. This is due to the differential thermal expansion between the ceramic and the cylinder head material, typically cast iron or aluminum.

An example of a valve guide composed of a ceramic material is disclosed in U.S. Pat. No. 4,688,527 issued to Donald H. Mott et al. on Aug. 25, 1987. This prior art design for inclusion with a cast metal cylinder head includes a ceramic valve seating and stem supporting integral device for supporting and sealingly interacting with a conventional engine poppet-type valve. The device is integrally cast together to form a unit for subsequent inclusion within the metal cylinder head of the internal combustion engine by casting. However, casting ceramic components within a cylinder head can be an expensive endeavor. The shrinking of the cast metal during the casting cooling process has a strong potential for over stressing the ceramic insert and causing it to crack. Exotic, precise, and costly controls must be maintained during the casting process to avoid this concern. The resultant interference fit, achieved during the casting cooling, will be lost once the engine is at operating temperature due to the differential thermal expansion between the ceramic and the cylinder head material. Additionally, such a cast-in ceramic insert does not allow the replacement of either the valve guide or the valve seat. This renders the cylinder head unsuitable for rebuilding in the event of either a component failure or time related wear-out.

The present invention is directed to overcoming the problems as set forth above.

DISCLOSURE OF THE INVENTION

In one aspect of the present invention, a valve guide assembly is adapted for use with a cylinder head. The cylinder head has a bore therein. The valve guide assembly includes a ceramic valve guide which has an outer surface. The ceramic valve guide is composed of a material having a low coefficient of expansion. A securing means circumferentially surrounds the ceramic valve guide and includes a lower securing element which circumferentially surrounds the ceramic valve guide and an upper securing element which circumferentially surrounds the ceramic valve guide. A separating means is disposed between the lower securing element and the upper securing element for forcing the lower securing element and the upper securing element into radial engagement with the outer surface of the ceramic valve guide and the bore in the cylinder head when an axial load is applied to the separating means during installation within the cylinder head.

In another aspect of the present invention, a method of mounting a ceramic valve guide into a cylinder head of an internal combustion engine is disclosed. The cylinder head has a bore therein terminating at an annular shoulder and a top surface. The method of mounting includes fitting a securing assembly around the ceramic valve guide at a fixed location to define a valve guide assembly. Then, inserting the valve guide assembly into the bore within the cylinder head. Next, seating the securing assembly against the annular shoulder so that a portion of the securing assembly extends beyond the top surface of the cylinder head. And finally, resiliently exerting a force against the securing assembly during installation so that an axial load is placed upon the securing assembly for forcibly connecting the ceramic sleeve with the cylinder head.

The present invention, through the use of a ceramic valve guide assembly which is simple, easily assembled, and economically mounted within an internal combustion engine provides a means for withstanding high exhaust temperatures for greater engine efficiency and durability.

BEST MODE FOR CARRYING OUT THE INVENTION

Figure 1:
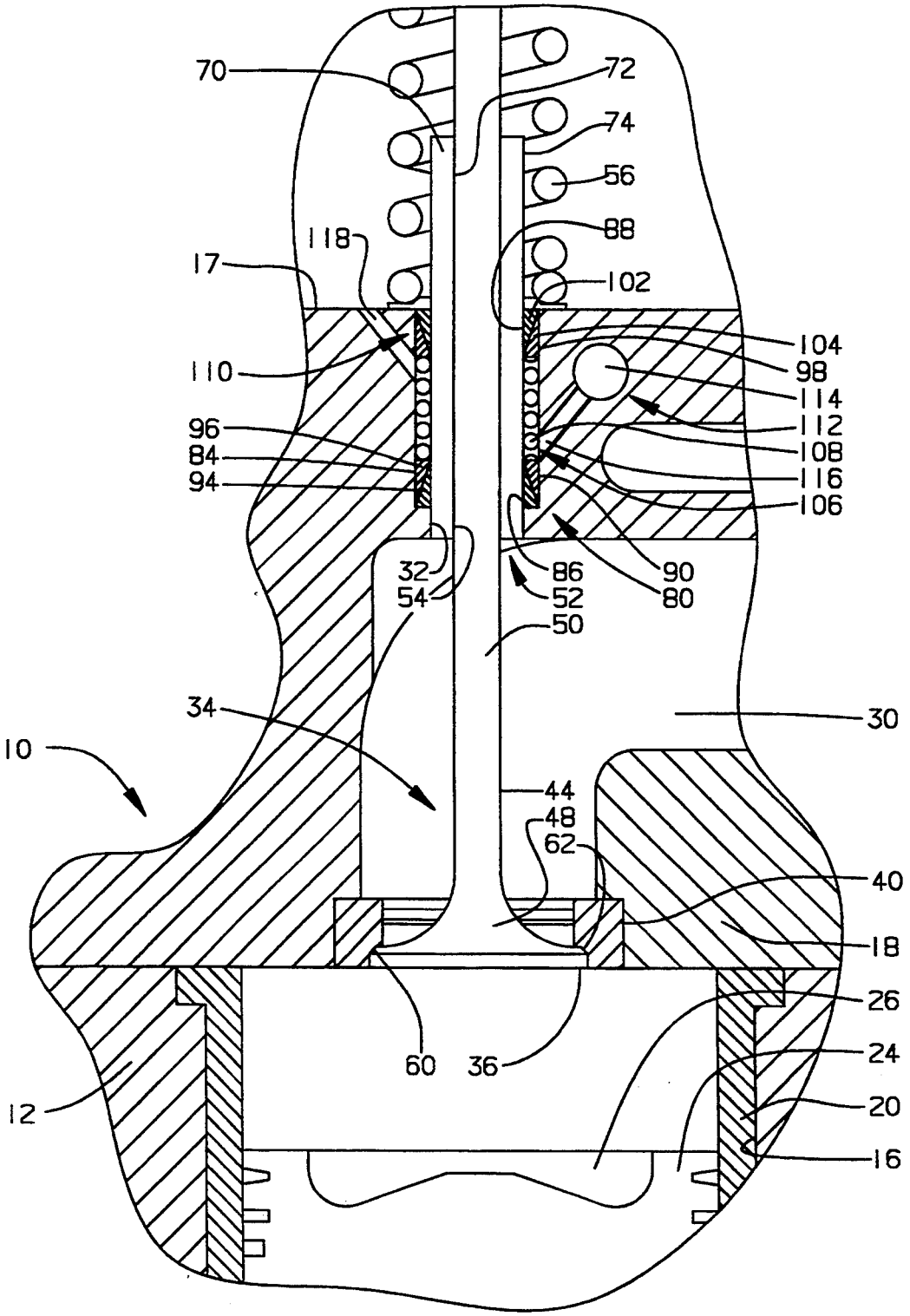
FIG. 1 is a partial section view of a combustion chamber for an internal combustion engine embodying the present invention.
Figure 2:
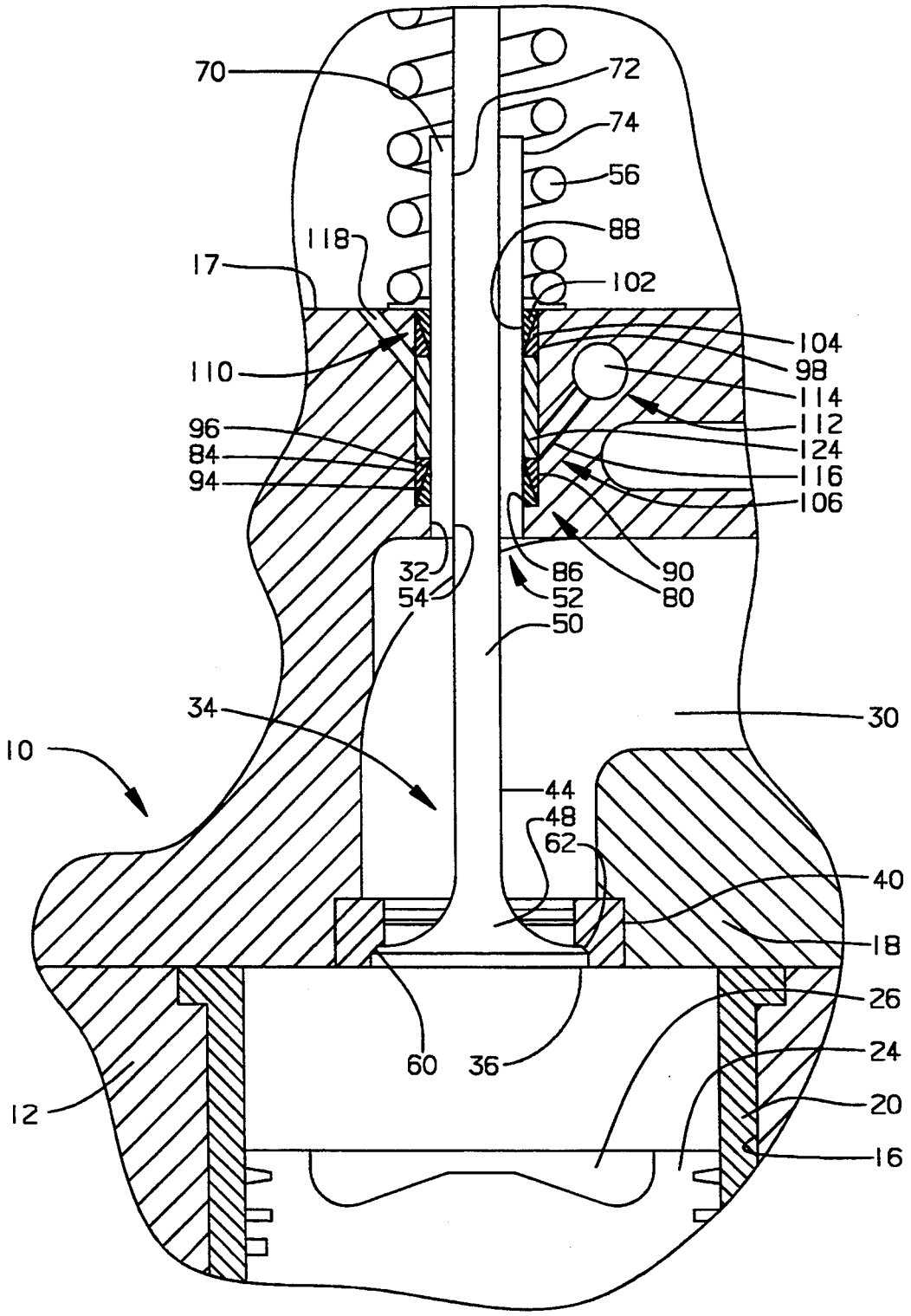
FIG. 2 is a partial section view of an alternative embodiment of the present invention shown in FIG. 1.

A partial view of an internal combustion engine 10 including a cylinder block 12 defining a cylinder bore 16 is shown in FIGS. 1 and 2. A cylinder head 18 is releasably mounted at the upper end of the cylinder block 12 in a conventional manner. The cylinder head has a top surface 19. A cylinder liner 20 is disposed within the cylinder bore 16. A piston 24 reciprocates in the cylinder liner 20 and cooperates with the cylinder head 18 to define a combustion chamber 26. Only a single cylinder has been illustrated and will be described. It should be understood, however, that the invention is capable of use in engines having multiple cylinders and various cylinder configurations.

An exhaust passage 30 is formed within the cylinder head 18 and is used for expelling gases out of the combustion chamber 26. A counterbore 32 formed within the cylinder head extends from the exhaust passage 30 and through the top surface 19 of the cylinder head 18. A valving arrangement 34 is operatively associated and fluidly connected with the combustion chamber 26 through an opening 36 encircled by an annular valve seat member 40. The valving arrangement 34 consists of a poppet-type valve 44 commonly used in internal combustion engines. The valve 44 includes an enlarged head portion 48 which is connected to an elongated cylindrical stem portion 50. The stem portion 50 is supported within a valve guide assembly 52 which is mounted into the counterbore 32 in the cylinder head 18. An interior bore 54 in the valve guide assembly 52 is sized to a predetermined dimension to closely encircle the stem portion 50 so that movement of the valve 44 is directed in a direct linear path. The movement of the valve 44 within the valve guide assembly 52 causes the enlarged head portion 48 to move toward and away from the piston 24 defining an open and closed position of the valve 44, respectively. The valve 44 is shown in the closed position in FIGS. 1 and 2. The valve 44 is urged to the open position in any suitable manner, such as by a mechanical, hydraulic, or electronic control means. A valve spring, similar to the one shown at 56, encircles the stem portion 50 and acts against a keeper (not shown) for urging the valve 44 to the closed position. The valve spring 56 has a preestablished pre-load. The head portion 48 includes an accurately ground inclined surface 60 thereabout which seats on a valve seat surface 62 in the valve seat member 40 when the valve 44 is in the closed position. Gases are expelled from the combustion chamber 26 and into the passage 30 when the valve 44 is in the open position as is well known in engine operation. It should be understood that although only an exhaust valve arrangement is described, the present invention may be used on an intake valve arrangement.

Referring more specifically to FIG. 1, the valve guide assembly 52 includes a valve guide 70, such as a ceramic sleeve, which has an inner surface 72 and an outer surface 74. The ceramic valve guide 70 is composed of a material, such as silicon nitride, boron carbide, or any suitable material which has a low coefficient of expansion, generally within the range of 2.5E-6 to 10.8E-6 mm/mm/C°.

The valve guide assembly 52 includes a securing means 80 which circumferentially surrounds the ceramic valve guide 70. The securing means 80 includes a lower securing element 84 seated against an annular shoulder 86 in the cylinder head 18 and an upper securing element 88. The lower securing element 84 includes a pair of mating frusto-conical elements 90 consisting of an inner member 94 and an outer member 96 concentric with the inner member 94. The upper securing element 88 includes a pair of mating frusto-conical elements 98 consisting of an inner member 102 and an outer member 104 concentric with the inner member 102. A separating means 106, such as a spring 108, is disposed between the lower securing element 84 and the upper securing element 88 and circumferentially surrounds the ceramic valve guide 70. The spring 108 is adjacent the outer member 96,104 of the lower and upper securing elements 84,88 and has a predetermined pre-load equal to or less than the pre-load of the valve spring 56. The spring 108 and the upper and lower securing elements 84,88 define a securing assembly 110. The valve spring 56 places an axial load upon the securing assembly 110, during assembly, which exerts a force against the lower and upper securing elements 84,88 and the spring 108 for forcibly connecting the ceramic valve guide 70 with the cylinder head 18.

A means 112 for cooling the ceramic valve guide 70 may be provided to compensate for the high exhaust temperatures experienced during engine operation. The cooling means 112 includes a cooling liquid gallery 114 supplied with cooling liquid, such as engine oil or engine coolant, from the engine. A first passage 116 fluidly connects the gallery 114 with the counterbore 32. A second passage 118 fluidly connects the counterbore 32 with the top surface 17 of the cylinder head 18.

Another embodiment of the present invention is shown in FIG. 2. It should be understood that the same reference numerals of the first embodiment are used to designate similarly constructed counterpart elements of this embodiment.

In FIG. 2, the separating means 106 is a solid sleeve 124 disposed between the lower securing element 84 and the upper securing element 88 to circumferentially surround the ceramic valve guide 70. The solid sleeve 124 is adjacent the outer member 96,104 of the lower and upper securing elements 84,88 and has a predetermined length selected to locate the upper inner securing element 102 slightly above the top surface 17 of the cylinder head 18. The solid sleeve 124 and the upper and lower securing elements 84,88 define the securing assembly 110. The valve spring 56, during assembly, places an axial load upon the securing assembly 110 which exerts a force against the lower and upper securing elements 84,88 and the solid sleeve 124 for forcibly connecting the ceramic valve guide 70 with the cylinder head 18.

Industrial Applicability

In order to provide a means for withstanding high exhaust temperatures, the valve guide assembly 52, including the securing assembly 110 and the ceramic valve guide 70, is installed within the cylinder head 18. This is accomplished by press-fitting the lower inner member 94 around the ceramic valve guide 70 to circumferentially surround the ceramic valve guide 70 at a fixed location. Next, the lower outer member 96 is seated against the lower inner member 94 so that the lower outer member 96 and the lower inner member 94 are in a contacting relationship circumferentially surrounding the ceramic valve guide 70. Next, the spring 108 is seated against the lower outer member 96 to circumferentially surround the ceramic valve guide 70. Next, the upper outer member 104 is seated against the spring 108 to circumferentially surround the ceramic valve guide 70. Finally, the upper inner member 102 is seated against the upper outer member 104 to circumferentially surround the ceramic valve guide 70. The valve guide assembly 52 is defined once the entire securing assembly 110 is fitted around the ceramic valve guide 70.

The valve guide assembly 52 is seated within the counterbore 32 in the cylinder head 18 until the lower inner member 94 is in contacting relationship with the annular shoulder 86. The relationship between the location of the lower inner member 94 on the ceramic valve guide 70 and the abutment of the lower inner member 94 with the annular shoulder 86 ensures that the securing assembly 110 extends beyond the top surface 17 of the cylinder head 18 a specified distance.

The valve spring 56 is assembled to the engine 10 in a well known fashion. When the valve spring 56 is installed and loaded, it exerts a force upon the securing assembly 110 axially. The axial load forces the securing assembly 110 downward into the counterbore 32 until the upper inner member 102 is flush with the top surface 17 of the cylinder block 18. Since the inner and outer members 96,102,104 of the frusto-conical elements 90,98, respectively, are radially split, the axial load exerted upon the securing assembly 110 by the valve spring 56 compresses the spring and forces the members 96,102,104 to contract or expand radially. Resultantly, as should be well understood, the lower outer member 96 expands radially gripping the cylinder head 18, the upper inner member 102 contracts radially gripping the ceramic valve guide 70, and the upper outer member 104 expands radially gripping the cylinder head 18. The contraction and expansion of the inner and outer members 96,102,104 forcibly connects the ceramic valve guide 70 with the cylinder head 18. It should be understood that the frustoconical elements 90,98 may be inverted and still function effectively as lower and upper securing elements 84,88, respectively.

If cooling liquid is needed, cooling liquid may be communicated from the gallery 114 through the first passage 116 directly into the counterbore 32 and around the spring 108. Cooling liquid circulates around the spring 108 and exits the counterbore 32 through the second passage 118 to the appropriate drain location for the cooling liquid being used, such as the top surface 17 of the cylinder head 18 for engine oil or the cooling jacket (not shown) for engine coolant. The inner member 94 acts to seal the cooling liquid from entering the counterbore 32 due, in part, to the press-fit of the inner member 94 around the ceramic valve guide 70. However, it should be noted that if the frusto-conical element 90 is inverted, sealing does not take place between the spring 108 and the counterbore 32.

It should be understood that the solid sleeve 124 can be used in place of the spring 108 to achieve similar results. It should also be understood that in order to utilize the cooling means 112 with the solid sleeve 124, openings would need to be added to accomplish adequate cooling.

In view of the above, since conventional shrink fitting a ceramic valve guide into a cylinder head results in an interference fit which is ultimately lost at engine operating temperatures due to the differential thermal expansion between the ceramic and the cylinder head material, the ability to mount a ceramic valve guide capable of withstanding high exhaust temperatures simply and economically within a cylinder head provides a means for achieving greater engine efficiency and durability. In the present invention, a ceramic valve guide is mounted within a cylinder head in a way that ensures that the ceramic valve guide is held in place within the cylinder head throughout the operating cycles of the engine. This is accomplished by forcibly connecting the ceramic valve guide, having a low coefficient of expansion, to the cylinder head, having a moderate coefficient of expansion, by utilizing a securing assembly therebetween.

We claim:

1. A valve guide assembly adapted for use with a cylinder head having a bore therein, comprising:

a ceramic sleeve having an outer surface, the ceramic sleeve being composed of a material having a low coefficient of expansion;

securing means circumferentially surrounding the ceramic sleeve and including a lower securing element circumferentially surrounding the ceramic sleeve and an upper securing element circumferentially surrounding the ceramic sleeve; and separating means disposed between the lower securing element and the upper securing element for forcing the lower securing element and the upper securing element into radial engagement with the outer surface of the ceramic sleeve and the bore in the cylinder head when an axial load is applied to the separating means during installation within the cylinder head.

2. The valve guide assembly of claim 1, wherein both the lower securing element and the upper securing element include a pair of mating conical elements, the pair of conical elements including an inner member and an outer member concentric with the inner member, the inner member of the lower securing element being securely fitted to the outer surface of the ceramic sleeve.

3. The valve guide assembly of claim 2, wherein the inner member of the lower securing element and the upper securing element is in radial engagement with the ceramic sleeve and the outer member of the lower securing element and the upper securing element is in radial engagement with the cylinder head when an axial load is applied to the separating means during installation within the cylinder head.

4. The valve guide assembly of claim 3, wherein the separating means is a coil spring.

5. The valve guide assembly of claim 3, where in the separating means is a solid sleeve.

6. A method of mounting a ceramic valve guide into a cylinder head of an internal combustion engine, the cylinder head having a bore therein terminating at an annular shoulder and a top surface, comprising the steps of:

fitting a securing assembly around the ceramic valve guide at a fixed location to define a valve guide assembly;

inserting the valve guide assembly into the bore within the cylinder head;

seating the securing assembly against the annular shoulder so that a portion of the securing assembly extends beyond the top surface of the cylinder head; and resiliently exerting a force against the securing assembly during installation so that an axial load is placed upon the securing assembly for forcibly connecting the ceramic valve guide with the cylinder head.

7. The method of mounting a ceramic valve guide of claim 6, wherein the step of fitting a securing assembly around the ceramic valve guide includes the steps of:

press-fitting a lower inner conical element around the ceramic valve guide at a fixed location;

seating a mating lower outer conical element against the lower inner conical element, the lower outer conical element being concentric with the lower inner conical element;

seating a separating means against the lower outer conical element, the separating means circumferentially surrounding the ceramic valve guide;

seating an upper outer conical element against the separating means, the upper outer conical element positioned around the ceramic valve guide; and seating a mating upper inner conical element against the upper outer conical element, the upper inner conical element being concentric with the upper outer conical element.

8. The method of mounting a ceramic valve guide of claim 7, wherein the step of resiliently exerting a force against the securing assembly includes the step of:

resiliently exerting a force against the separating means during installation.

9. The method of mounting a ceramic valve guide of claim 8, wherein the step of forcibly connecting the ceramic valve guide with the cylinder head includes the steps of:

forcibly contracting the upper inner conical element toward the ceramic valve guide;

forcibly expanding the upper outer conical element toward the cylinder head; and forcibly expanding the lower outer conical element toward the cylinder head.

10. The method of mounting a ceramic valve guide of claim 9, wherein the step of seating a separating means includes the step of:

seating a coil spring against the lower outer conical element.

11. The method of mounting a ceramic valve guide of claim 9, wherein the step of seating a separating means includes the step of:

seating a solid sleeve against the lower outer conical element.

* * * * *